United States Patent [19]

Achinger et al.

[11] 4,442,882

[45] Apr. 17, 1984

[54] MACHINE FOR PRODUCING FLASKLESS MOLDS

[75] Inventors: Michael Achinger, Bgm. Ebnerstr. 20, 8904 Friedberg-Stätzling; Walter Streitenberger, Friedberg-Derching; Otto K. H. Voigt; Hans Wolter, both of Augsburg, all of Fed. Rep. of Germany

[73] Assignee: Michael Achinger, Friedberg-Statzling, Fed. Rep. of Germany

[21] Appl. No.: 299,278

[22] Filed: Sep. 4, 1981

[30] Foreign Application Priority Data

Sep. 6, 1980 [DE] Fed. Rep. of Germany ..... 3033652
Sep. 19, 1980 [DE] Fed. Rep. of Germany ..... 3035335

[51] Int. Cl.[3] ..... B22D 15/08

[52] U.S. Cl. ..... 164/187; 164/207; 164/213

[58] Field of Search ..... 164/187, 182, 188, 207, 164/213, 40

[56] References Cited

U.S. PATENT DOCUMENTS

| | | | |
|---|---|---|---|
| 3,303,535 | 2/1967 | Rearwin et al. | 164/213 X |
| 3,589,431 | 6/1971 | Fellows | 164/187 X |
| 3,744,552 | 7/1973 | Lundsgart | 164/187 |
| 3,749,151 | 7/1973 | George et al. | 164/187 X |
| 3,838,731 | 10/1974 | Abraham et al. | 164/187 X |
| 3,967,672 | 7/1976 | Wallwork | 164/188 X |
| 3,999,594 | 12/1976 | Gunnergaard | 164/187 |
| 4,313,486 | 2/1982 | Kondo et al. | 164/200 |

FOREIGN PATENT DOCUMENTS

| | | | |
|---|---|---|---|
| 54-110927 | 8/1979 | Japan | 164/207 |
| 612751 | 6/1978 | U.S.S.R. | 164/207 |

*Primary Examiner*—Gus T. Hampilos
*Assistant Examiner*—J. Reed Batten, Jr.
*Attorney, Agent, or Firm*—Edwin E. Greigg

[57] ABSTRACT

A plurality of molding boxes having a common center line are disposed in an aligned manner in a horizontal guideway located, in the direction in which pressure is exerted and expulsion is effected, between a pressure piston and an outwardly pivotable pressing device and the molding devices are displaceable in the guideway. One pattern carrier plate is provided between each of the individual molding boxes, and the pattern carrier plates can be moved in and out when the molding boxes are apart. A tilting device is disposed at the outlet of the machine, which selectively either allows pressed mold bodies to pass by it with the position of their seams unchanged, or tilts the mold bodies, pressed in pairs, by an angle of 90°.

17 Claims, 7 Drawing Figures

MACHINE FOR PRODUCING FLASKLESS MOLDS

Figures 1, 2:
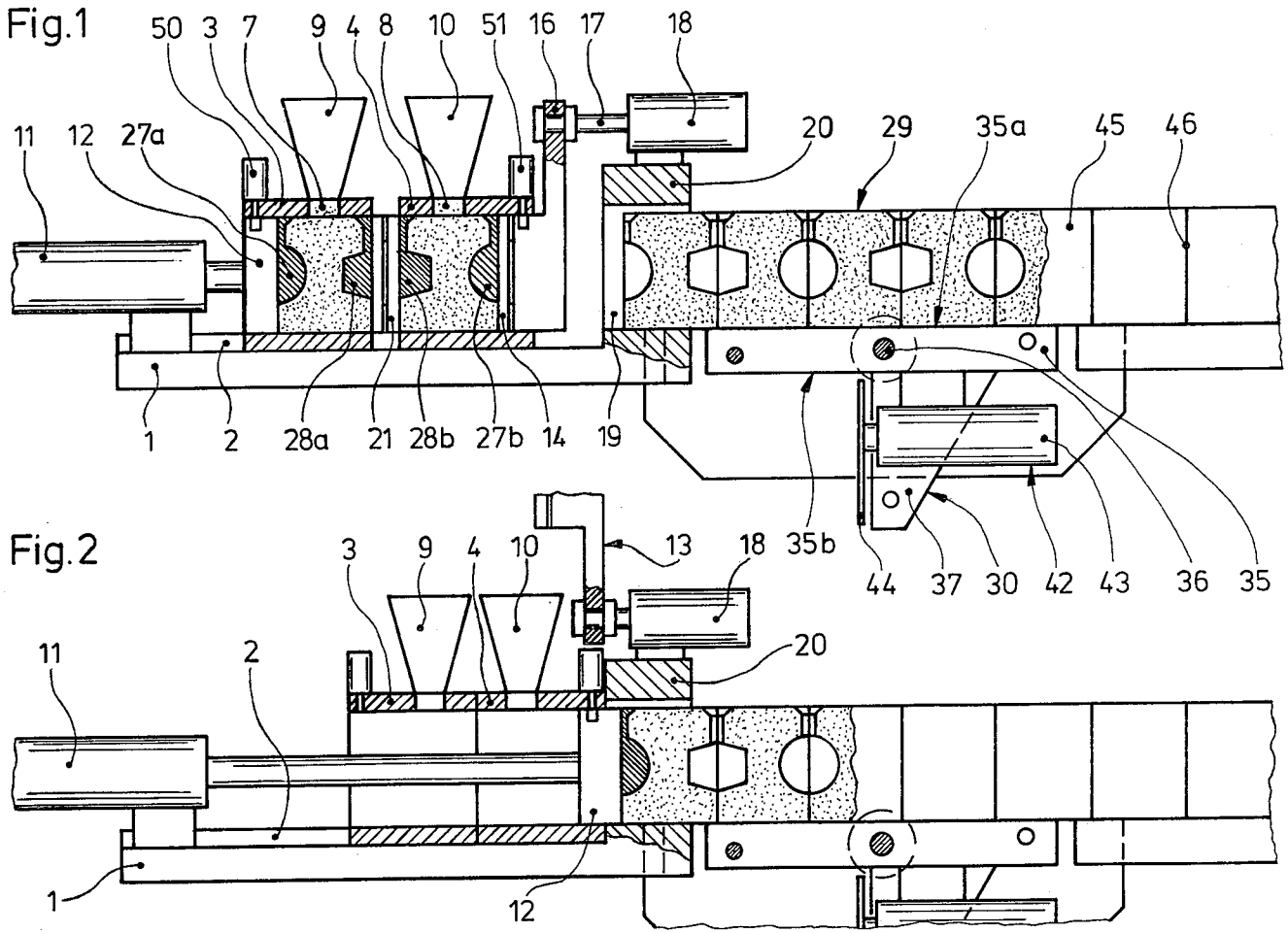

The invention relates to a molding machine for producing flaskless molds, having a molding box open at both sides and with its central line located horizontally. One opening of the molding box is closable by a horizontally operating pressure piston, and the opposite opening is closable by an outwardly pivotable pressing device. On at least one of the pressure faces oriented toward one another, one pattern half each can be secured. The machine also has a stacking device onto which the finished, pressed mold bodies, after the pressing device has pivoted outward, can be displaced horizontally all the way through the molding box with the aid of the pressure piston. In these machines, the pressure forces are exerted on the molding material in the horizontal direction. The result is one-piece mold bodies, in the end faces of each of which a mold cavity has been impressed, so that when placed on the stacking device, a course of mold bodies with vertical seams is produced (see German Pat. No. 12 11 760, for example).

This procedure has significant advantages over that in which the pressure forces are exerted vertically into the molding sand. In that case, two mold-body halves are required for each mold; that is, for n molds, 2n mold halves are required. In the case where the direction of manufacture is horizontal, only n+1 mold bodies are required. This results in an enormous reduction in the amount of molding sand required and a correspondingly great savings in energy and time. After the filling of the molds and hardening of the molten metal, the hardened molds are destroyed in a known manner, and the cast pieces are removed. The lumps of molding sand are then ground, dust is removed from the recovered sand, and the sand is sprayed with water in order to cool it. After drying, the sand thus reprocessed is returned to the foundry. This process necessitates a great expenditure of energy and time, which increases in proportion with the total quantity of molding sand required in a foundry. The great advantage of the molding machine described at the outset above, where the direction of manufacture is horizontal, is primarily that in comparison with machines where the direction of manufacture is vertical, it requires little more than half as much molding sand.

Various proposals have already been made for increasing the output of molding machines with a horizontal pressure direction. For instance, in the continuous molding system described in German Pat. No. 24 05 371, the molding box carrier is embodied as a turntable with an incremental drive, and a plurality of molding boxes are disposed in pairs opposite one another, so that a plurality of compression and discharge stations are created, which are actuated simultaneously. This machine thus necessitates a significant constructional expenditure, because each pressure station requires its own pressing device and each discharge station requires its own expulsion device. The insertion of cores would also be complicated, since it can be accomplished only in an intermediate station. Because of the centrifugal force associated with the rotation, the cores must additionally be fastened in place, for instance by being nailed down. Furthermore, in the case of a turntable, a certain amount of play must be provided. This, in turn, increases the danger that the mold halves will not be placed so as to match exactly. The result is increased misplacement and thus the danger of a greater number of rejects.

In the molding machine of German examined application DE-AS No. 25 38 645, intended for stacking pairs of mold bodies having a horizontal seam, two mold cavities are disposed in each of two slide frames, which are displaced in opposite directions, transversely to the horizontal pressure direction. One of the slides thus fabricates the lower halves of the molds, while the other slide fabricates the upper mold halves. The machine also has two pressing devices, which act at either side on an abutment plate inserted in between the slides. By means of bloating seals, the seams between the abutment plate and the mold cavities located in the pressing position are sealed off. After the pressing procedure, the slides are displaced into the outset position, and the two mold bodies are each moved onto a tilting device, and there they are tilted by 90° about a horizontal axis, transversely to the expulsion direction. In the completion station, one upper half of a body is raised at a time, while the appropriate lower half is pushed beneath it. Finally, the mold bodies thus completed are driven transversely in pairs onto a common transport device and taken to the casting station. The transverse movement of the slide plates alone, whether horizontal or vertical, necessitates a certain amount of play, which increases the danger of an excessively great misplacement of mold halves. However, the many movements of the flaskless mold body halves in the horizontal and vertical direction and the many changes of direction increase the danger of misplacement, and thus of rejects, still further.

Like the above machine, the molding machine of German laid-open application DE-OS No. 22 28 806 is also equipped with two double molding boxes displaceable transversely with respect to the horizontal pressure direction; however, they are disposed at such a distance from one another that there is room between them for a pressing device operating in both horizontal directions, so that the molding sand is compressed from both sides. Thus four courses of mold bodies are produced, located in pairs in rows and parallel to one another. To stack mold bodies with horizontal seams, here again two mold-body halves are placed together, outside the machine, with their seams vertical; they are then rotated by 90° by a tilting device and are driven onto a transport system transversely to the pressure direction. Because of the unavoidable play between the two double molding boxes and because of the long displacement distances of the mold bodies, a great deal of misplacement with this machine is again unavoidable.

Finally, U.S. Pat. No. 3,695,339 discloses a molding machine operating with two vertical pressure stations. Two mold halves are pressed separately; the molding boxes are then tilted in opposite directions by 90°, placed together in an axial guideway with the aid of additional drive devices for each box, and are discharged with a separate expulsion device. With this machine, however, it is not possible to produce continuous courses of mold bodies with horizontal seams.

The object of the present invention is to increase the output capacity of molding machines with a horizontal pressure direction, while avoiding the deficiencies of the machines described above, and to embody the machines such that continuous courses of mold bodies can also be created selectively with the mold-body halves having horizontal seams. Despite the superiority of the machines with a horizontal pressure direction in terms of the length of time required for manufacture, the amount of molding sand required, and the like, these machines are not suitable when strict requirements for a homogeneous structure pertain, especially for producing molds for relatively flat and narrow cast pieces. Such is the case, for instance, with brake discs, clutch plates and the like, which are cast from wear-resistant, hard-cast alloys. If such pieces are cast in an upright position, then primarily because of gravity, the result after hardening is a non-homogeneous crystalline structure, which produces varying coefficients of friction at the working faces of these machine elements. Accordingly, one was heretofore forced to use molding machines with a vertical pressure direction at least for such uses.

The invention is defined in that at least one further molding box, open at both sides, is disposed in alignment with the first molding box between the pressure piston and the pressing device; that all the molding boxes are displaceable along the central line of the molding boxes in a common, horizontal guideway located in the pressure and discharge direction; and that one pattern carrier plate is provided between each two adjacent molding boxes, the cross section of which corresponds to the inside cross section of the molding boxes, and the pattern carrier plate or plates can be driven inward and outward, in a manner known per se, when the molding boxes have been pulled apart.

Thus in accordance with the invention, a plurality of mold bodies is created with only a single set of pressing tools. A particular advantage of the invention is also that the pressed mold-body halves are already placed together inside the machine, assuring a minimum of mismatching. With the combination, according to the invention, of molding boxes which are axially displaceable in a row and pattern carrier plates which can be driven inward and outward, this machine is excellently well suited for coating the patterns outside the molding machine. In the machines known in the prior art and discussed earlier above, such procedures could be used—if at all—then only with extreme difficulty.

In order to attain the alternative fabrication capability, a further embodiment of the invention provides that a tilting device is disposed at the outlet of the machine, which selectively permits the pressed mold bodies to continue past with their seams in an unchanged position, or with which the mold bodies, pressed in pairs, are tilted by 90°.

It might be said against the invention that the costs for production and storage of the patterns then increase many fold, if only one and the same mold is supposed to be produced. For a large-scale foundry, this would hardly carry any weight. However, it is also possible—as before— for one pair of pattern halves each to suffice if, in accordance with a further proposal of the invention, different pattern halves are attached in alternation to the pressing tools and to the pattern carrier plates.

Figure 3:
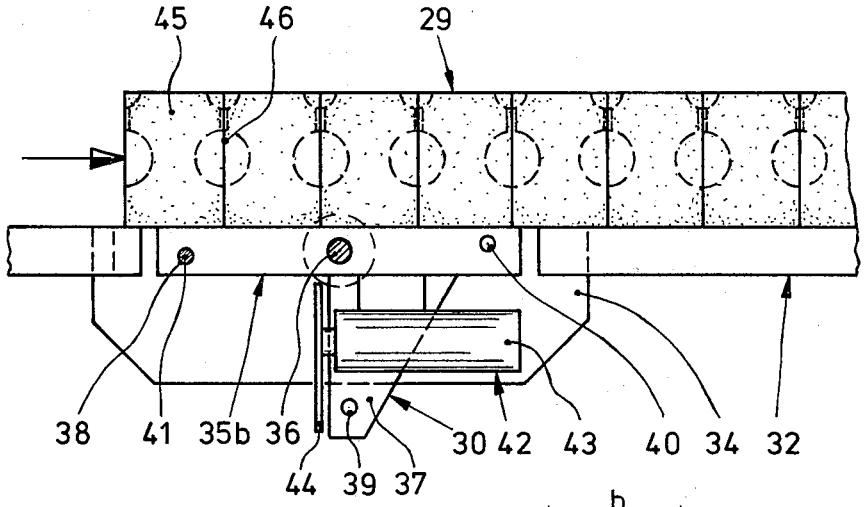
Figure 4:
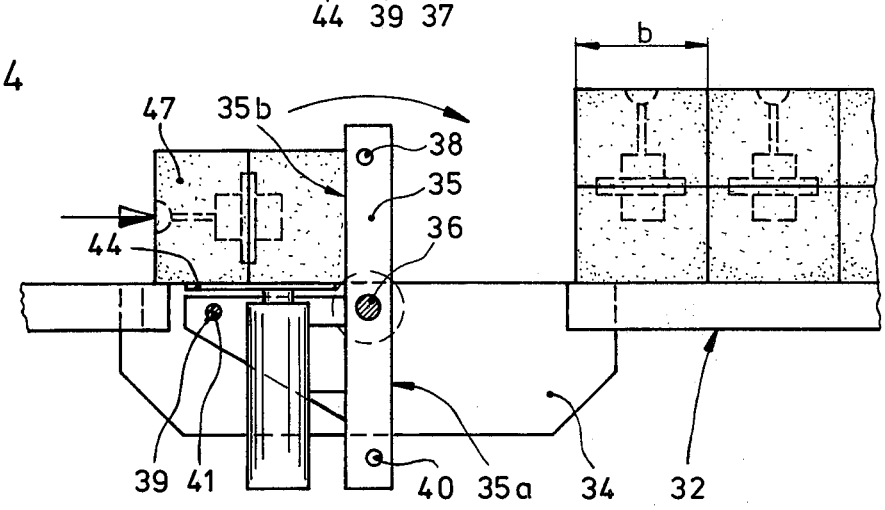
Figure 5:
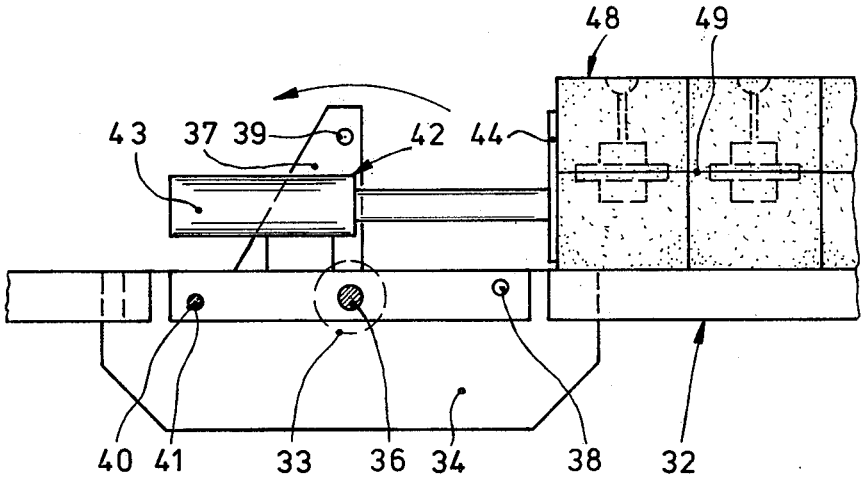
Figure 6:
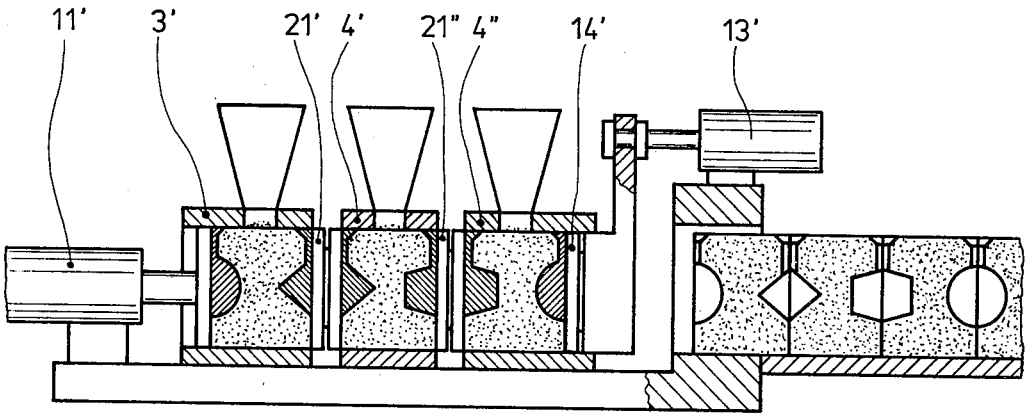
Figure 7:
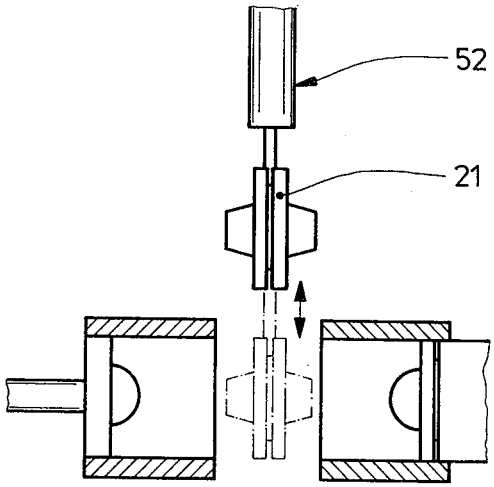

The invention will be described in further detail below in terms of several exemplary embodiments. The associated drawings show the following:

FIG. 1, a longitudinal section taken through a molding machine having two molding boxes, in the operating position for pressing;

FIG. 2, the molding machine of FIG. 1, in the operating position for expulsion;

FIG. 3, the tilting device, disposed at the outlet of the molding machine, for stacking courses of mold bodies with vertical seams in the position for being allowed to continue pass;

FIG. 4, the tiling device of FIG. 3 for stacking courses of mold bodies with horizontal seams in the loading position;

FIG. 5, the tilting device of FIG. 4 after pivoting by a further 90° in the unloading position;

FIG. 6, a longitudinal section through a molding machine analogous to FIGS. 1 and 2, having three molding boxes in the pressing position; and FIG. 7, a plan view on the apparatus for driving the pattern carrier plate in and out.

Reference numeral 1 indicates a machine bed, with swallowtail guideways 2 in which horizontally located molding boxes 3 and 4 are supported in an axially displaceable manner. Each molding box has an opening 7, 8 on its top, by way of which molding-sand funnels 9, 10 are attached. A pressure cylinder 11 is secured on the left-hand end of the machine bed 1 and its pressure piston 12 has penetrated the molding box 3. On the opposite end, there is a pressing device 13 with a flask-shaped pressure head 14, which can be spread apart by internal pressure; the pressure head is secured by means of a pivoting arm 16 to the shaft 17 of a servomotor 18 and can be both axially displaced and pivoted by this servomotor.

The servomotor 18 itself is secured to a frame 20 surrounding an outlet opening 19, the frame simultaneously serving as a stop for the molding box when the mold bodies are expelled (FIG. 2). Between the two molding boxes 3, 4, there is a pattern carrier plate 21, whose cross section corresponds to the inside cross section of the molding boxes 3, 4 and which is likewise embodied such that it can be spread apart by internal pressure. It is supported between the molding boxes in such a manner as to be axially displaceable (floating) in the direction of the central line of the molding boxes, so as to be capable of evading unequal pressure exertion on one side, and it is driven inward and outward transversely to the pressure and expulsion direction with an adjusting cylinder 52 shown in FIG. 7.

The molding boxes 3, 4 can be coupled by means of mechanical couplings 50, 51 to the pressure piston 12 and the pressure head 14, so that they can thereby be displaced back and forth for the various work cycles. The pattern halves belonging to one another, which here have different contours, are designated by reference numerals 27*a*, 27*b* and 28*a*, 28*b*.

In the outset position, the two molding box halves 3, 4 have been driven apart; the pattern carrier plate 21 is located outside the machine. The individual steps in the operation take place as follows, with the respective terminal positions being assured by appropriate stops:

1. Driving the pattern carrier plate 21 with the pattern halves 28*a*, 28*b* inward;
2. coupling the molding box 4 to the pressing tool 14 (note: from the foregoing cycle, the molding box 3 is still coupled to the pressure piston 12);
3. closure of the two molding boxes 3, 4 by means of axial displacement;
4. introduction of the molding material, perhaps with the aid of pneumatic means;
5. uncoupling of the molding boxes and simultaneous exertion of pressure by the pressure piston, the pressing device and the pattern carrier plate;
6. coupling and pulling apart of the two molding boxes 3, 4;
7. driving the pattern carrier plate 21 outward;

8. inserting cores if needed;

9. uncoupling the molding box 4 and driving and pivoting the pressure head 14 outward;

10. displacing the molding boxes 3, 4 as far as the stop on the frame 20;

11. uncoupling the molding box 3 and expelling the two mold bodies through the outlet opening 19 toward the course of mold bodies 29; and 12. returning the molding boxes 3, 4 coupled to the pressure piston to their outset positions, the molding box 4 being uncoupled from the pressure piston 12 after attaining its outset position.

In FIG. 6, a molding machine is shown which is in principle identical to that shown in FIGS. 1 and 2, but which has three molding boxes 3', 4', 4'', between which a number of pattern carrier plates 21', 31'' equal to the number of molding box stacks is disposed. Since these pattern carrier plates can be spread apart and can be subjected to the same pressure as the pressing tools 11' and 13', it is assured that the molding material will be compressed equally well in the middle molding box 4' as in the molding boxes 3' and 4'' located at either end. Theoretically, the number of molding boxes could accordingly be increased arbitrarily.

When the mold bodies are stacked on the course 29 of mold bodies, they travel past a tilting device 30, which will be explained in greater detail with the aid of FIGS. 1, 3, 4 and 5.

The tilting device 30 comprises a carrier plate 35 driven by a hydrostatic motor 33; in the 0° position, it has an upper carrier face **35*a* and a lower carrier face 35*b* parallel to it. In the middle, it is rotatably supported about horizontal axis 36 in side walls 34, which is transverse to the transport direction and its thickness is dimensioned such that the carrier faces 35*a*, 35*b* in a respective operating position are in alignment with the level of the stacking device and of the outlet of the molding machine. Arresting holes 38, 39 and 40, in which an arresting bolt 41 finds a detent in the 0°, 90° and 180° movement phases, are cut into the narrow longitudinal sides of the carrier plate 35 at opposite ends as well as into a crossbar 37**.

Displacement device 42, comprising a hydraulic or pneumatic adjusting cylinder 43 and a thrust plate 44, directed at right angles to the lower carrier face **35*b*, is attached below the carrier plate 35** (viewed in the 0° position).

FIGS. 1 and 3 show the tilting device in the operating position in which mold bodies 45, in each of the ends of which one half-mold has been shaped, are combined as they leave the machine to make a continuous course 29 of mold bodies with vertical seams 46. They thus travel past the upper carrier face **35*a* of the tilting device 30**.

In producing and stacking mold bodies with horizontal seams, only two molding boxes (FIGS. 1 and 2) are used, and the pattern halves **27*a*, 27*b* are removed. The steps in the operation are the same as those listed above under points 1–12. Only in step 11 are the two mold bodies 47 not displaced as far as the continuous mold-body course; instead, they are displaced onto the thrust plate 44 of the tilting device 30, which has been pivoted by 90° and fixed in that position; the lower carrier face 35*b* then serves simultaneously as a stop (FIG. 4). Finally, the carrier plate 35 is rotated by a further 90° into the 180° phase of rotation and locked in the arresting hole 40. In this position, the displacement device 42 displaces the mold bodies 47, which have been turned by 90°, with a width b toward a continuous course 48 of mold bodies; seams 49 are then located horizontally (FIG. 5**).

We claim:

1. A machine for producing flaskless molds having a first molding box open at both sides and a horizontally extending center line passing through the open sides, one open side of which is closable by a horizontally operating pressure piston and the opposite open side is closable by an outwardly pivotable pressing device, and in which one half of a pattern is secured to each of the pressure piston and the pressing device oriented toward one another, a stacking device onto which a completed, pressed mold body, after outward pivoting of the pressing device, is pressed horizontally all the way through the first molding box with the aid of the pressure piston, characterized in that at least one further molding box open at both sides is disposed in alignment with the first molding box between the pressure piston and the pressing device, all the molding boxes are displaceable along the center line of the molding boxes in a common, horizontal guideway, located in the direction of pressure and discharge, and that between each two adjacent molding boxes a pattern carrier plate is provided, the number of which is equal to the number of the molding box seams, whose cross section in a direction perpendicular to the center line corresponds to the inside cross section of the molding boxes so that said pattern carrier plate can enter into said molding boxes, each pattern carrier plate being displaceable along said center line in the pressure and discharge direction, and each carrier plate being constructed and arranged to be extracted from between the molding boxes when taken apart.

2. A machine as defined by claim 1, characterized in that each pattern carrier plate is embodied as a pressing device.

3. A machine as defined by claim 1, characterized in that different pattern halves are attachable in alternation to the pressure piston, the pressing device and to the pattern carrier plates.

4. A machine as defined by claim 1, characterized in that means are provided for coupling the molding boxes to the pressure piston and the pressing device.

5. A machine as defined by claim 1, characterized in that disposed at its outlet is a tilting device, which selectively permits the pressed mold bodies to continue bast it with its seams in an unchanged position, or with which the mold bodies pressed in pairs can be tilted by 90°.

6. A machine as defined by claim 5, characterized in that the tilting device comprises a carrier plate which is supported such that it is rotatable by 180° about its horizontal center axis, and which has an upper carrier face and a lower carrier face, which in their operating positions are in alignment with the level of the stacking device, and that a displacement device acting in the pressure direction is secured to the lower carrier face with a thrust plate directed at a right angle to the displacement device.

7. A machine as defined by claim 4, characterized in that different pattern halves are attachable in alternation to the pressure piston, the pressing device and to the pattern carrier plates.

8. A machine as defined by claim 7, characterized in that disposed at its outlet is a tilting device, which selectively permits the pressed mold bodies to continue past it with its seams in an unchanged position, or with which the mold bodies pressed in pairs are tilted by 90°.

9. A machine as defined by claim 8, characterized in that the tilting device comprises a carrier plate, which is supported such that it is rotatable by 180° about its horizontal center axis, and which has an upper carrier face and lower carrier face, which in their operating positions are in alignment with the level of the stacking device, and that a displacement device acting in the pressure direction is secured to the lower carrier face with a thrust plate directed at a right angle to the displacement device.

10. A machine for producing flaskless molds having a first molding box open at both sides and a horizontally extending center line passing through the open sides, one open side of which is closable by a horizontally operating pressure piston and the opposite open side is closable by an outwardly pivotable pressing device, and in which one half of a pattern is secured to each of the pressure piston and the pressing device oriented toward one another, a stacking device onto which a completed, pressed mold body, after the outward pivoting of the pressing device, is pressed horizontally all the way through the molding box with the aid of the pressure piston, characterized in that at least one further molding box open at both sides is disposed in alignment with the first molding box between the pressure piston and the pressing device, all the molding boxes are displaceable along the center line of the molding boxes in a common, horizontal guideway, located in the direction of pressure and discharge, and that between each two adjacent molding boxes a pattern carrier plate is provided, the number of which is equal to the number of the molding box seams, whose section in a direction perpendicular to the center line corresponds to the inside cross section of the molding boxes so that said pattern carrier plate can enter into said molding boxes, each pattern carrier plate being embodied as a pressing device and being constructed and arranged to be laterally extracted from the molding boxes upon separation of the latter.

11. A machine as defined by claim 10, characterized in that different pattern halves are attached in alternation to the pressure piston, the pressing device and to the pattern carrier plates.

12. A machine as defined by claim 10, characterized in that means are provided for coupling the end molding boxes to the pressure piston and pressing device respectively.

13. A machine as defined by claim 10, characterized in that disposed at its outlet end is a tilting device, which selectively permits the pressed mold bodies to continue past it with its seams in an unchanged position, or with which the mold bodies pressed in pairs are tilted by 90°.

14. A machine as defined by claim 13, characterized in that the tilting device comprises a carrier plate, which is supported such that it is rotatable by 180° about its horizontal center axis, and which has an upper carrier face and a lower carrier face, which in their operating positions are in alignment with the level of the stacking device, and that a displacement device acting in the direction is secured to the lower carrier face with a thrust plate directed at a right angle to the displacement device.

15. A machine as defined by claim 10, characterized in that means are provided for coupling the end molding boxes to the pressure piston and pressing device, respectively.

16. A machine as defined by claim 15, characterized in that disposed at its outlet is a tilting device, which selectively permits the pressed mold bodies to continue past it with its seams in an unchanged position, or with which the mold bodies pressed in pairs are tilted by 90°.

17. A machine as defined by claim 16, characterized in that the tilting device comprises a carrier plate, which is supported such that it is rotatable by 180° about its horizontal center axis, and which has an upper carrier face and a lower carrier face, which in their operating positions are in alignment with the level of the stacking device, and that a displacement device acting in the pressure direction is secured to the lower carrier face with a thrust plate directed at a right angle to the displacement device.

* * * * *